US005765782A

United States Patent [19]

De Vettor

[11] Patent Number: 5,765,782

[45] Date of Patent: Jun. 16, 1998

[54] SAFETY DEVICE FOR THE MANOEUVRING AND AUXILIARY WINCHING OF SELF-PROPELLED VEHICLES

[75] Inventor: Gianfranco De Vettor, Busche, Italy

[73] Assignee: MDP Meccanica del Piave SpA, Longarone, Italy

[21] Appl. No.: 673,690

[22] Filed: Jun. 25, 1996

[51] Int. Cl.[6] ..... B65H 75/40

[52] U.S. Cl. ..... 242/403; 242/557; 242/158.3; 254/271

[58] Field of Search ..... 242/158.3, 158.4, 242/403, 534.2, 548.1, 557; 414/569; 254/271, 335, 382

[56] References Cited

U.S. PATENT DOCUMENTS

| | | | |
|---|---|---|---|
| 3,309,066 | 3/1967 | Carlson et al. | 242/158.3 |
| 3,692,112 | 9/1972 | Tucker . | |
| 4,005,834 | 2/1977 | Landreau | 242/158.3 |
| 5,385,314 | 1/1995 | Hughes | 242/403 |

FOREIGN PATENT DOCUMENTS

| | | | |
|---|---|---|---|
| 305 344 | 1/1973 | Austria . | |
| 2 377 962 | 8/1978 | France . | |
| 1 809 441 | 8/1969 | Germany . | |
| 2 301 623 | 7/1974 | Germany . | |
| 353 315 | 5/1961 | Switzerland . | |
| 429 803 | 8/1967 | Switzerland . | |
| 2 041 317 | 9/1980 | United Kingdom | 242/158.3 |

*Primary Examiner*—John P. Darling
*Attorney, Agent, or Firm*—McAulay Fisher Nissen Goldberg & Kiel, LLP

[57] ABSTRACT

A safety device for the manoeuvring and auxiliary winching of self-propelled vehicles used on steep slopes is provided with a winding drum (30) around which a winching cable (28) is wound, said cable having one end (28*a*) fixed to the top of the slope to be travelled up. The device (18) comprises moreover a pair of rollers (34, 36) around which the cable (28) is passed in advance, before being wound around the winding drum (30). The device (18) comprises finally a manoeuvring arm (20), rotatable about a vertical axis (Y), along which the cable (28) runs. The manoeuvring arm (20) is provided with a motor (26) for positioning thereof about the vertical axis (Y) and can be tilted through 90° about a horizontal axis (X).

20 Claims, 14 Drawing Sheets

SAFETY DEVICE FOR THE MANOEUVRING AND AUXILIARY WINCHING OF SELF-PROPELLED VEHICLES

The present invention relates to a safety device for the manoeuvring and auxiliary winching of self-propelled vehicles used on steep slopes.

Purely by way of a non-limiting example, in the description below specific reference will be made to use of the device for vehicles employed on snow-covered terrain which are commonly referred to as "snow cats" or piste beaters; it is understood, however, that the scope of the invention also extends to use of the device on other types of vehicles.

Snow cats or piste beaters are widely used in skiing resorts in order to flatten the snow and thus make the snow-covered surface of the skiing pistes uniform.

In view, therefore, of the extremely difficult conditions in which these vehicles are required to operate, they are usually provided with crawler tracks driven by a suitable motor.

However, the action of the motor alone may not be sufficient to cope with steep slopes or to keep the vehicle stable should the underlying snow layer give way. Consequently, the vehicle could suffer serious damages and furthermore, a drawback which is even more serious, the lives of the persons operating the vehicle could be endangered.

In order to eliminate these drawbacks, the vehicles according to the known art are provided with a device comprising a manoeuvring arm fixed to the vehicle freely rotatably about a vertical axis. The manoeuvring arm has running along it a winching cable, a first end of which is fixed to the top of the slope to be travelled up, while the second end is wound around a winding drum driven by a motor.

The device is further provided with braking means designed to prevent the undesirable reverse rotation of the winding drum, thus preventing release of the cable coiled up inside the drum itself.

The winching device not only facilitates travel of the vehicle uphill, but also makes it possible to deal with difficult situations where manoeuvring would be particularly arduous and dangerous such as, for example, in the cases described above.

Finally, since the manoeuvring arm is freely rotatable, it is always arranged in the same direction as the winching cable, independently of the position of the vehicle. Consequently the pulling force of the cable always passes along the vertical axis of rotation of the manoeuvring arm, thereby preventing the generation of moments which could make the vehicle unstable.

The abovementioned winching device, however, has various drawbacks including those arising from the direct connection between the winching cable and the winding drum. More specifically, in view of the irregular nature of the snow layer, the winching cable is frequently subject to sudden stresses which are correspondingly transmitted onto the winding drum and which increase the wear of the winching cable. Consequently, on account of these sudden forces of considerable intensity, the winding member is subject to a high degree of fatigue with a consequent reduction in its working life.

A further drawback is due to the fact that, since the cable wound around the winding drum tends to bunch up rather than be distributed uniformly over the entire width of the drum, the winding diameter of the cable gradually increases by a substantial amount. With a constant speed of rotation of the winding drum, the linear speed at which the cable is coiled up around the drum gradually increases and hence, as the vehicle moves forward, the speed of forward movement of the vehicle must increase correspondingly in order to prevent the upward pulling force from being transmitted mainly to the winding drum motor. In practice, the result is that the vehicle, when it sets off, is moving more slowly than when it reaches its destination.

Moreover, the cable wound around the drum under great tension is subject to rubbing forces and, being compressed between the underlying turns of cable and the overlying turns, becomes flattened. The rubbing and deformations wear out the cable and reduce its working life so that periodic checking and replacement of the cable is required, said operations being long, laborious and costly.

Considering, moreover, the sometimes sudden stresses to which the cable is subject, it can be easily understood how the said cable, while winding around the winding drum, tends to become entangled, making it difficult to perform the reverse operation, i.e. release of the cable from the winding drum.

A further drawback is caused by the vertical dimensions of the vehicle since the presence of low overhead obstacles on the skiing pistes could prevent transportation of these vehicles and moreover, still for the same reason, could prevent parking of the vehicle in garages with low ceilings.

Finally, in the case of the devices of the known art, there is an initial phase of tensioning of the cable during which, following fixing beforehand of both its ends, if the manoeuvring arm is not aligned with the cable it rotates violently about its vertical axis, moving from its initial position into the position where it is aligned with the cable —a sudden rotation which can be damaging not only for the winching device, but also for the persons who might be on or in the vicinity of the vehicle.

The aim of the present invention, therefore, is to devise and provide a device in which all the drawbacks mentioned in connection with the cited prior art are eliminated, i.e. a device in which both the intensity of the sudden forces which affect the winding drum and the wear of the cable is reduced and finally in which winding of the cable around the winding drum is made uniform and the difference existing between the starting speed and the speed of arrival of the vehicle is eliminated.

A further aim of the invention is to provide a device which makes it possible for the vehicle, on which it is mounted, to be transported in the case where overhead obstacles are present and to be parked in garages with low ceilings.

Finally, during the phase when the cable is tensioned, the manoeuvring arm must be prevented from rotating violently out of control about its vertical axis.

These aims are achieved by means of a device of the type described in the introduction, i.e. comprising a manoeuvring arm associated with the vehicle itself and freely rotatable about a vertical axis, a winding drum operated by drive means and designed to wind at one end a winching cable running along said arm, while the other end of the cable is fixed to the top of the slope to be travelled up, said device being further provided with braking means designed to prevent release of the cable wound around the winding drum, characterized in that it comprises at least one guide and traction roller around which the cable is wound with friction for a plurality of turns before being coiled up by means of winding around said winding drum, said device being further characterized in that it comprises a detection and control member designed to detect the winding radius of the cable wound around the winding roller and to adjust the speed of rotation of the winding roller drive means so that the linear speed with which the cable is coiled up is constant.

In a particular embodiment of the invention, said braking means are applied to said at least one guide roller and are designed to prevent release of the cable wound around the winding drum.

In this way, when a difficult situation occurs in which the power of the vehicle's engine is not sufficient to oppose the high strain to which the winching cable is subject, the braking means block rotation of said at least one roller. The frictional force which develops between the cable and said at least one guide roller opposes the strain to which the cable is subject, preventing release thereof from the winding drum and therefore preventing the vehicle from moving backwards.

If, however, a particularly difficult situation should occur, such as for example the negotiation of a hump or the yielding of the underlying snow layer, the pulling force of the winching cable would reach the limit value consisting of the frictional force generated between the cable itself and the guide roller. When this critical value is reached, the tensile stress to which the cable is subject does not increase and the winching cable starts to slip slowly on the guide roller causing release of the cable wound around the winding drum. In this way, by limiting the maximum stress to which the cable can be subject, the probability of breakage of the winching device is reduced and its working duration is increased.

Finally, slipping of the cable along the guide roller allows the vehicle to move backwards in a controlled manner and hence move away from the obstacle encountered. In the new situation, which is decidedly more favourable, the operator can regain control of the vehicle and hence start moving again.

In a particular embodiment, said at least one guide roller is operated by drive means.

The task of coiling up the cable is in this case fulfilled precisely by said guide roller drive means so that the section of cable comprised between said at least one guide roller and said winding drum is stressed by a sufficiently small amount to keep the cable slackened. By so doing, the rubbing forces and compression which the cable undergoes are reduced, limiting wear and flattening of the said cable.

Furthermore, since the speed of rotation of the guide rollers is constant, the linear coiling speed of the cable is also constant so that the departure speed of the vehicle and the speed of arrival are the same.

In a further embodiment of the invention said guide rollers are two and the winching cable is wound alternately around the first and the second roller inside grooves formed on each of the two guide rollers.

The section of cable when winding around the two guide rollers is subject to significant stresses, but since the cable is guided inside grooves, the rubbing action between adjacent turns of the cable is substantially reduced. Furthermore the rollers are made preferably of soft material such that the rollers and not the cable are subject to wear. In this way the checking operations as to the extent of wear and any replacement of the worn components are simplified considerably.

In another embodiment the device comprises a cable distributor which performs a transverse movement and is located between said guide rollers and said winding drum and is designed to allow winding of the cable such that it is uniformly distributed around the drum itself.

The cable is therefore wound uniformly over the entire width of the winding drum such that there is a smaller increase in the winding diameter of the cable so that, with the linear coiling speed of the cable being constant, the number of revolutions of the winding drum will vary by a smaller amount.

Furthermore the possibility that the cable may become entangled is reduced to a minimum.

In another embodiment the manoeuvring arm is pivotably mounted about an axis which is substantially horizontal and parallel to the longitudinal axis of the vehicle so as to be able to assume a first operating position in which it is arranged vertically and a second operating position in which it is tilted horizontally.

Obviously by tilting the manoeuvring arm through 90° from the vertical position, the vertical dimensions of the vehicle are reduced, making it possible to park and transport the vehicle even in the presence of structures with a low ceiling.

Finally, in a further embodiment, the device comprises drive means and transmission means designed to rotate the manoeuvring arm about its vertical axis. In this way, after suitably fixing the cable to the device and firstly tensioning it, by means of these drive means the manoeuvring arm is positioned so as to align it with the cable. During the next phase, i.e. during tensioning of the cable, the manoeuvring cable is not subject to any sudden rotation.

In this way, since the linear coiling speed of the cable is constant, the starting speed of the vehicle and the speed of arrival are the same.

These and further characteristic features and advantages of the invention will emerge more clearly from the following detailed description, provided by way of a non-limiting example, with reference to the accompanying drawings in which.

Figure 1:
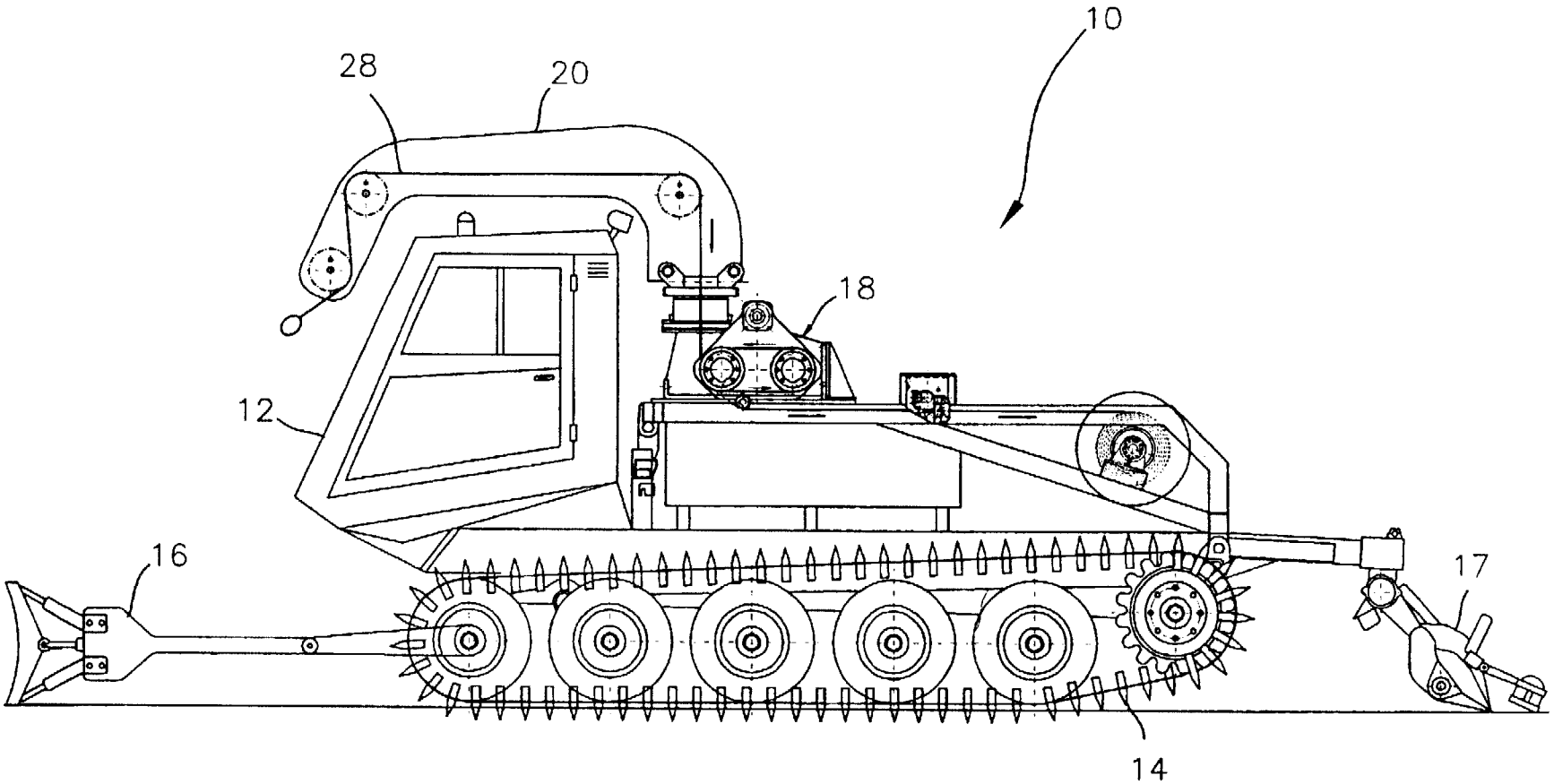
FIG. 1 is a side view of a snow cat comprising a manoeuvring and auxiliary winching device according to the present invention.

In FIG. 1, 10 denotes in its entirety a self-propelled vehicle used on ski pistes and commonly referred to as a snow cat or piste beater.

The vehicle 10 comprises a frame or bodywork 12 provided with crawler tracks 14 which facilitate the uphill travel of the vehicle on the ski pistes; furthermore. The vehicle 10 is provided both at the front and at the rear with smoothing blades denoted by 16 and 17, respectively, which each have the function of making the snow layer level. Finally, the frame 12 is provided with a safety device for manoeuvring and auxiliary winching, denoted overall by 18.

Figures 2, 3:
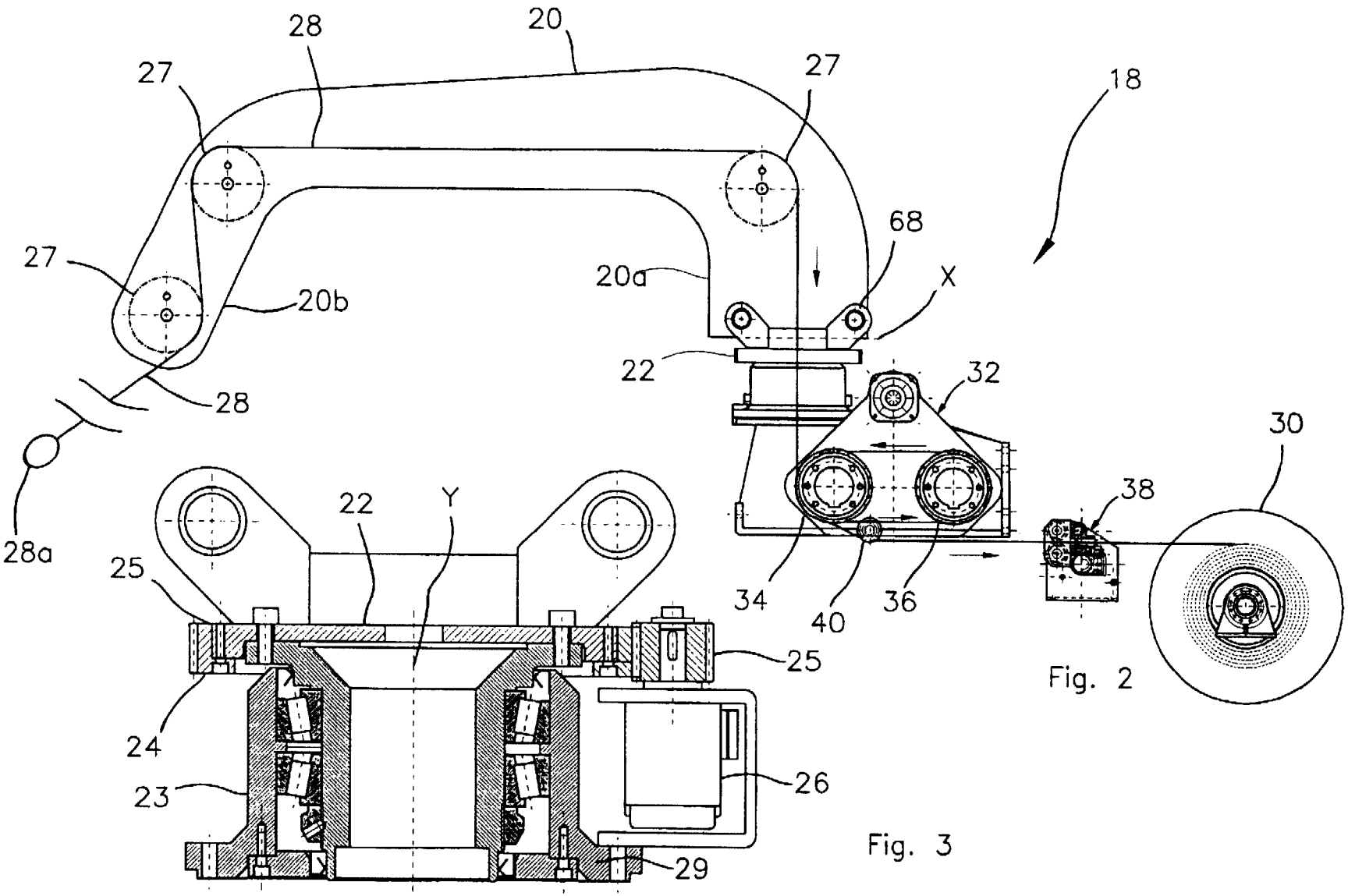
FIG. 2 is a partially sectioned side view of the device illustrated in FIG. 1.
FIG. 3 illustrates an enlarged and partially sectioned detail of FIG. 2.

The device 18, as can be seen more clearly in FIG. 2, comprises a manoeuvring arm 20 which extends horizontally and has opposite ends 20*a*, 20*b*. The end 20*a* is fixed to a support 22 which is mounted rotatably, about a vertical axis Y, on a base 23 rigidly fixed to the frame 12. As regards initial positioning of the manoeuvring arm 20 with respect to the connection between vehicle and the point for fixing of the cable and with reference to FIG. 3, it can be noted that the rotating support 22 is integral with a toothed wheel 24 which meshes with the pinion 25 integral with the drive shaft 26. A pair of bearings 29 are located between the rotating support 22 and the base 23.

The manoeuvring arm 20 is provided with pulleys 27 having, running over them, a winching cable 28, one end 28a of which is fixed to the top of the slope to be travelled up. The cable 28 travels first of all over the pulleys 27 and is then suitably coiled up by the device itself.

For this purpose the device 18 comprises a winding drum 30 operated by a suitable motor, not shown in the Figures, around which the cable 28 is wound.

Figure 6:
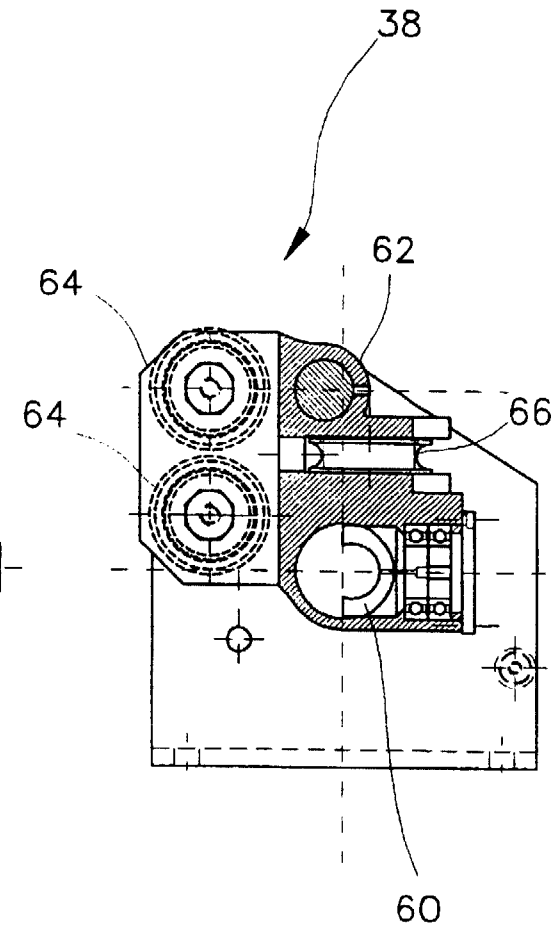
FIG. 6 shows, on a larger scale, the cable distributor illustrated in FIG. 2.
Figure 7:
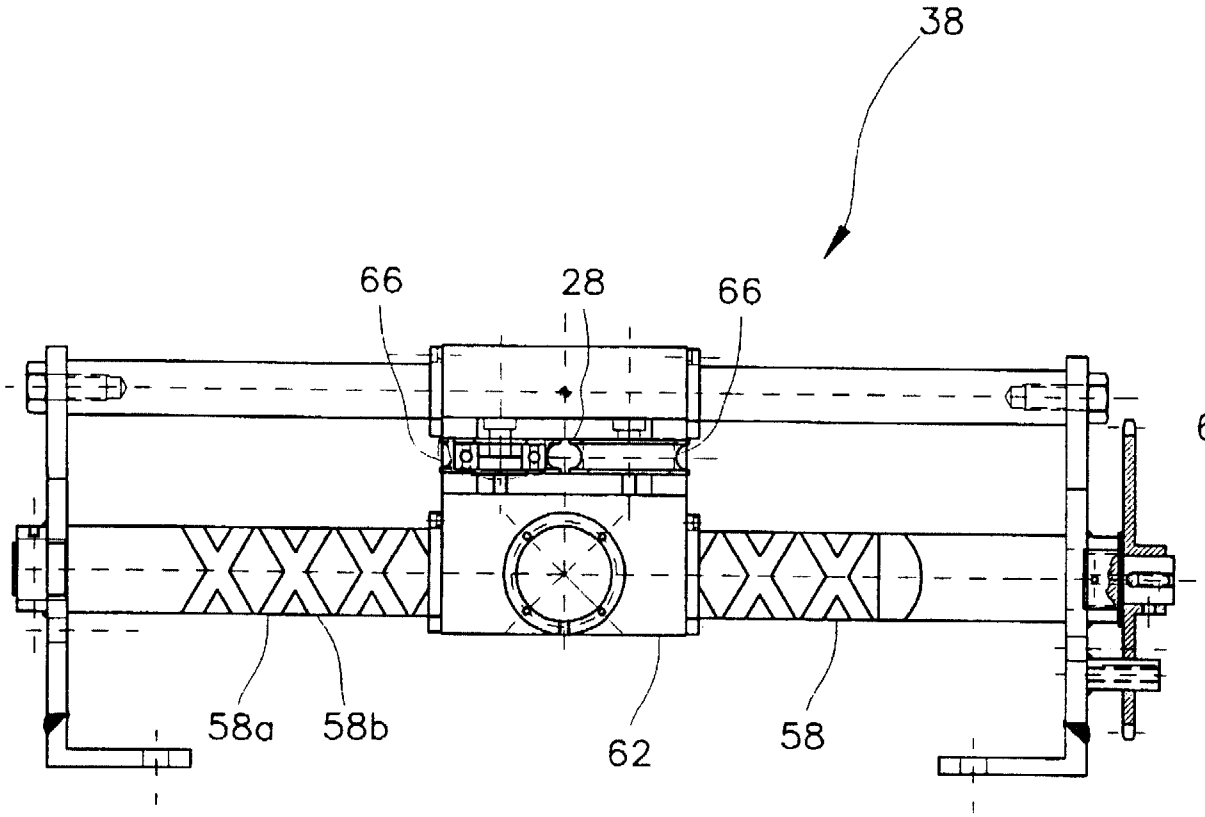
FIG. 7 is a longitudinal view of the cable distributor shown in FIG. 5.

The device 18 comprises, moreover, a friction group, denoted overall by 32, which is located between the manoeuvring arm 20 and the winding drum 30 and is provided with two rollers 34 and 36, having mutually parallel axes, around which the cable 28 is wound for a few turns in the manner and for the purposes which will be specified below with reference to FIGS. 4 and 5, before being wound around the winding drum 30. Finally, a device 38 for distributing the cable 28, described in detail below with reference to FIGS. 6 and 7, is located between the friction member 32 and the winding drum 30 and has the function of uniformly distributing the turns of the cable 28 over the surface of the winding roller 30.

A deviating roller 40 is located in a position underlying the friction group 32 and between the latter and the distributor 38, said roller having the function of deviating the section of cable emerging from the friction group 32 so that it does not interfere with the group itself.

Figure 4:
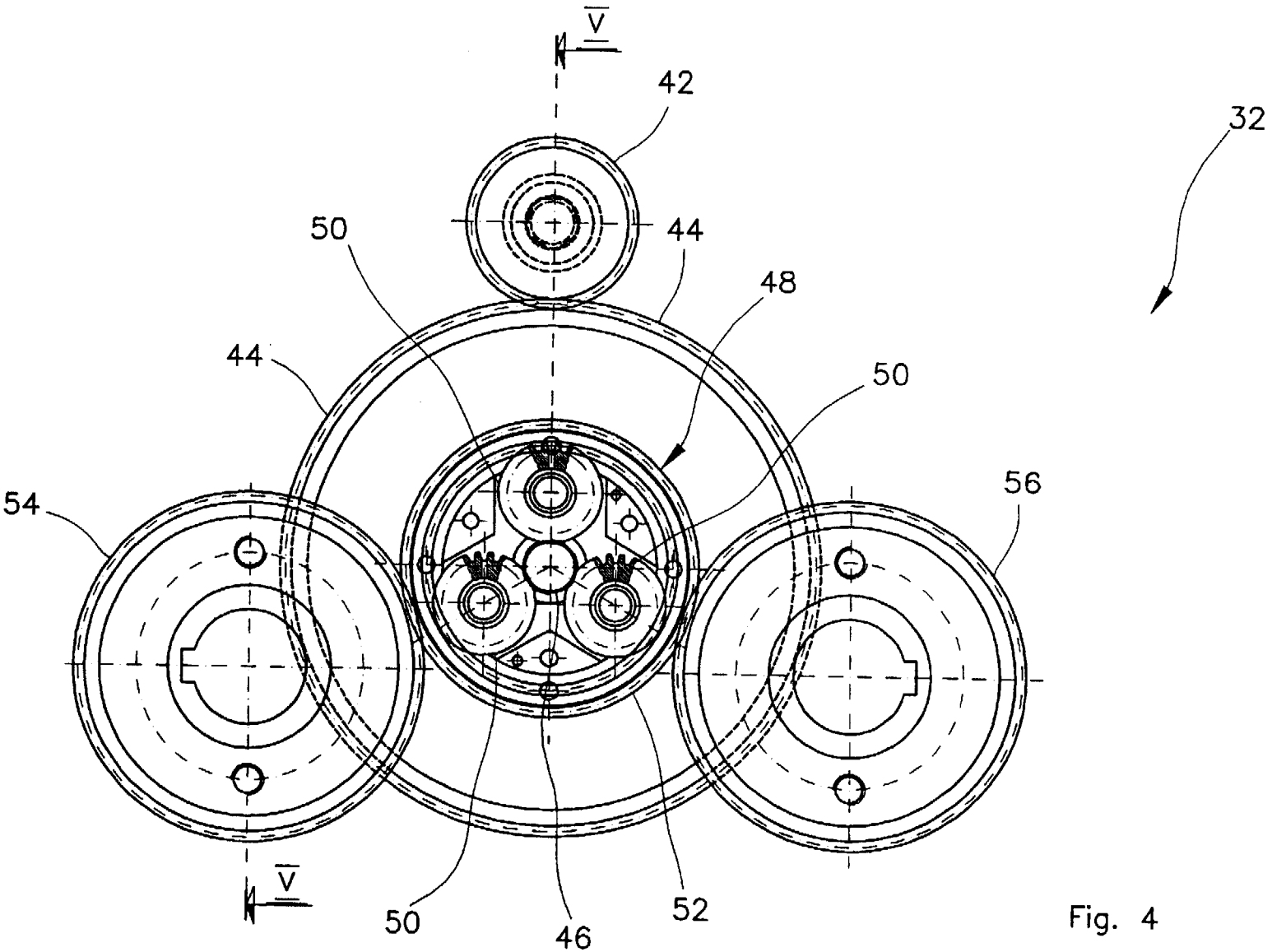
FIG. 4 is a cross-section through the friction group of the device shown in FIG. 2.
Figure 5:
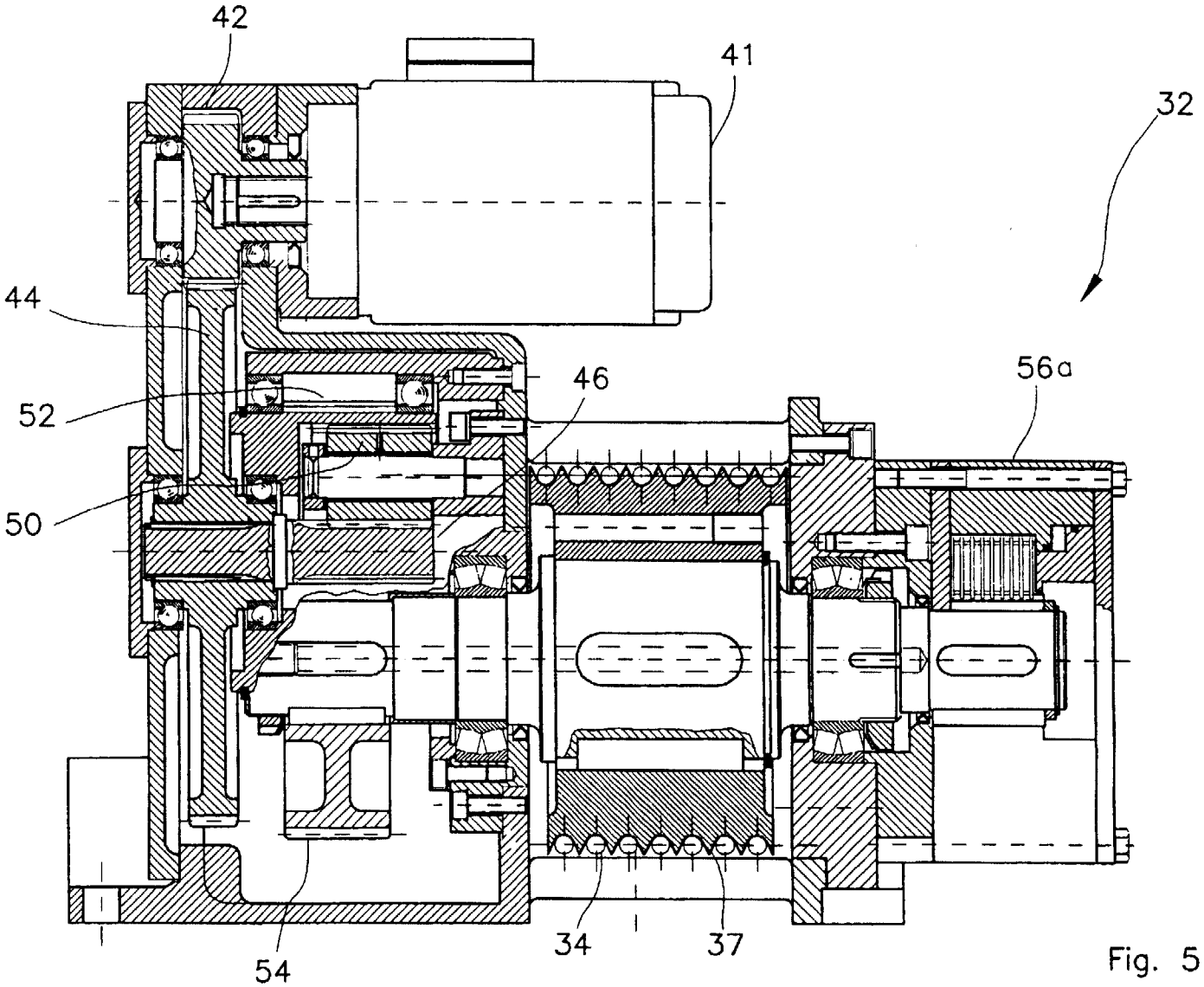
FIG. 5 is a section along the plane indicated by V-V in FIG. 4.

Considering now FIGS. 4 and 5, it can be noted that the friction group 32 comprises a hydraulic motor 41, the shaft of which is provided with a pinion 42 meshing with a toothed wheel 44. The toothed wheel 44 is locked in rotation with the central or sun gear 46 of an epicyclic reducer 48. The sun gear 46 is in meshing engagement with three peripheral or planetary gears 50 of the reducer 48 arranged angularly at the same distance from one another along the external toothing of the sun gear 46. The three planetary gears 50 mesh with the internal toothing of a crown ring 52 provided with an external toothing meshing with two toothed wheels 54 and 56 locked in rotation with the guide rollers 34 and 36, respectively.

Each guide roller 34 and 36, as illustrated in FIG. 5, is provided with a plurality of grooves 37, preferably seven, inside which the cable 28 is wound.

The friction group 32 is provided, moreover, for each guide roller 34 and 36, with a hydraulic lamellar safety brake of the commercial type., denoted overall by 56*a* and having the function of blocking reverse rotation of the rollers 34 and 36, preventing release of the cable 28 wound around the winding drum 30.

FIGS. 6 and 7 illustrate, on the other hand, the cable distributor 38 which has the function of allowing the cable 28 to be wound uniformly over the entire width of the winding drum 30. The distributor 38 comprises a screw 58 with a left-hand thread 58*a* and a right-hand thread 58*b* with one of which there engages a half-crown ring 60 integral with an element 62 for guiding the cable 28, any rotation of which about the screw 58 is prevented. The guide element 62 comprises a first and a second pair of rollers denoted by 64 and 66, respectively; in each pair 64, 66 the rollers are arranged opposite one other and the cable 28 emerging from the friction group 32 passes between them. The axes of the pair of rollers 64 are parallel to the axes of the guide rollers 34 and 36 of the friction group 32, while the axes of the pair of rollers 66 are rotated through 90°, with respect to the axes of the pair of rollers 64, about the section of cable 28 emerging from the friction group 32.

When the screw 58 is made to rotate by the winding drum 30 via a special mechanical coupling, not illustrated in the Figures, the half-crown ring 60 and hence the guide element 62 are displaced along the screw 58 in the direction which depends on the type of threading in which the half-crown ring 60 is engaged. Once the end of the screw 58 has been reached, the half-crown ring 60 stops and engages with the other threading, then travelling along the screw 58 in the opposite direction to the previous one, until it reaches the other end of the screw where a further reversal of the movement occurs.

Obviously the length of the screw 58 is equal to the axial extension of the winding drum 30 so that the cable is coiled up over the entire surface of the drum. For uniform winding at each revolution of the winding drum 30, the distribution device 38 must move a distance equivalent to the diameter of the cable so that, if for example the pitch of the threads of the screw 58 is equal to the diameter of the cable 28, one turn of the screw 58 must correspond to each revolution of the winding drum 30.

Figure 9:
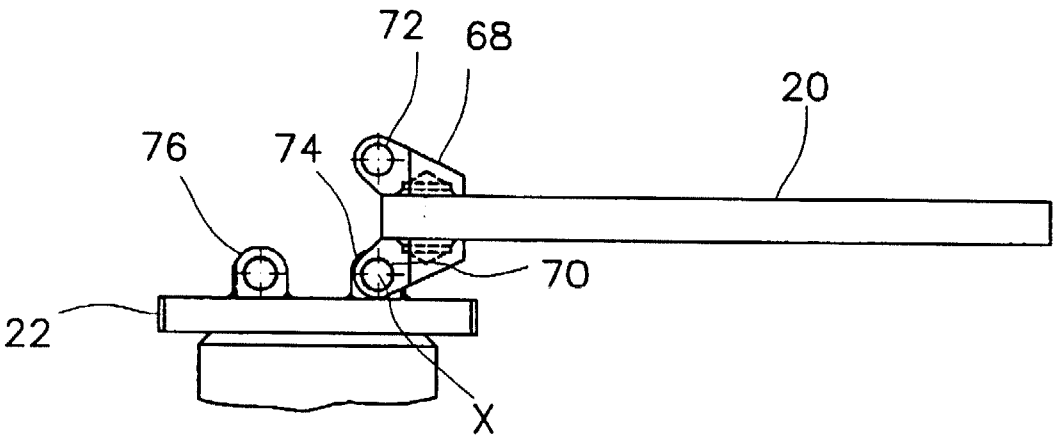
FIGS. 8 and 9 are two front views of the manoeuvring arm of the device according to FIG. 2, shown in the vertical and horizontal position, respectively.
Figure 8:
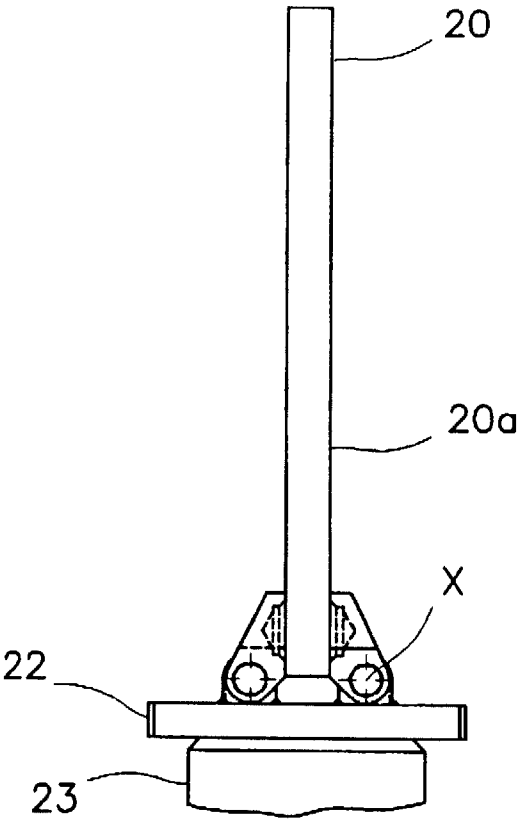
Figure 10:
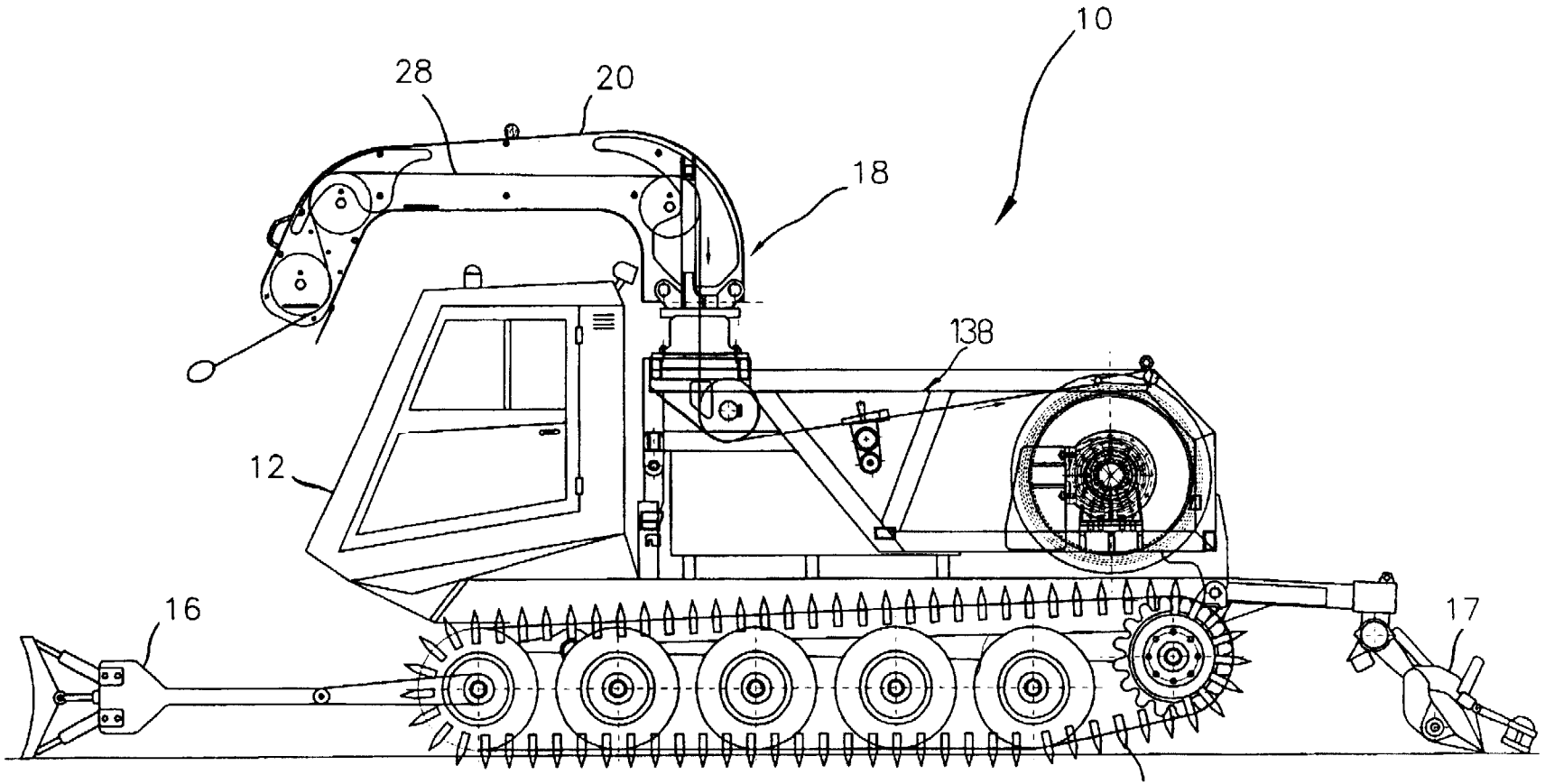
FIG. 10 is a partially sectioned side view of a further embodiment of the snow cat comprising a monoeuvring and auxiliary winching device according to the present invention.
Figure 11:
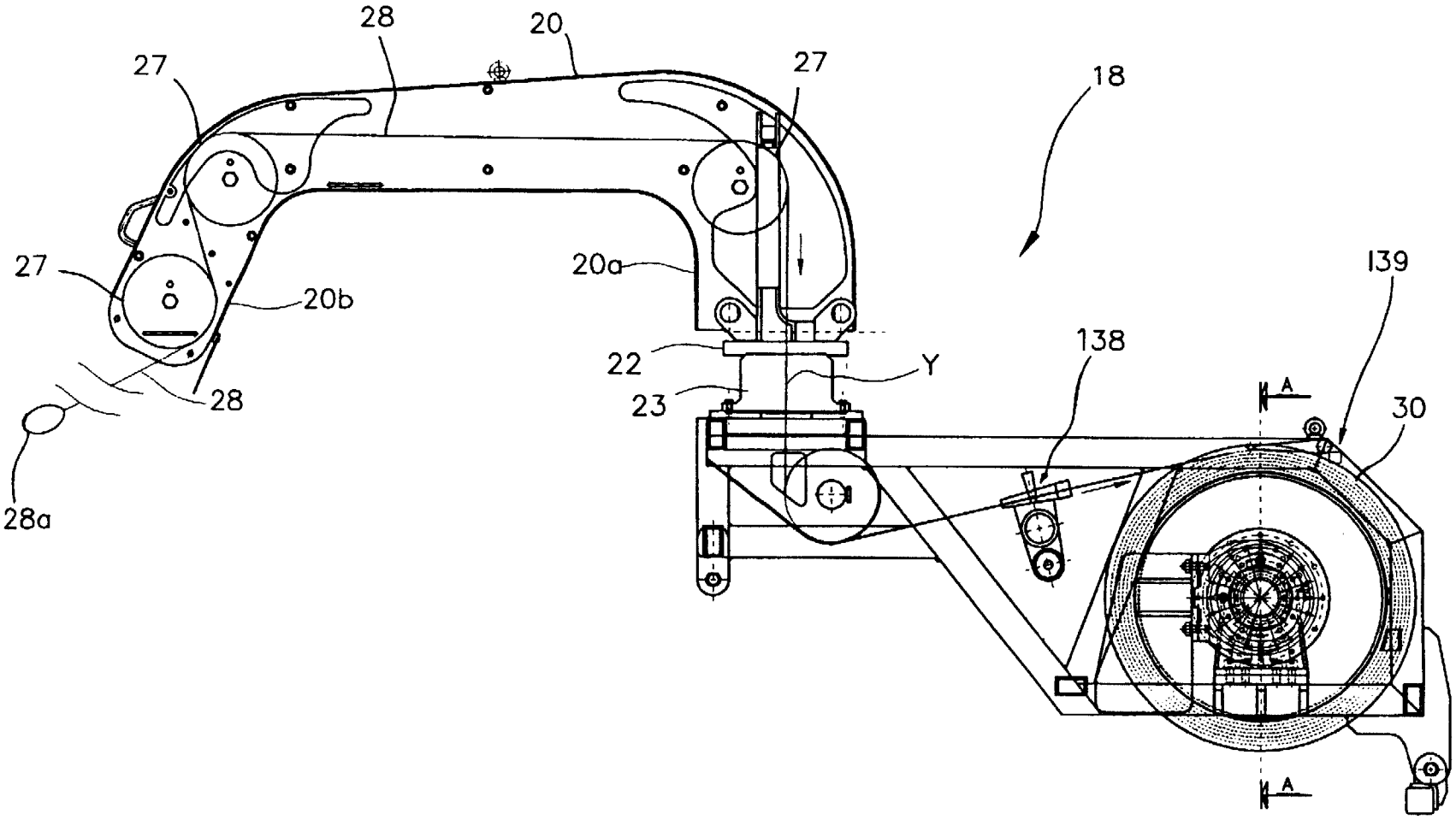
FIG. 11 is a partially sectioned side view of the device illustrated in FIG. 10.

In FIGS. 2, 8 and 9, finally, it can be noted that the end 20a of the manoeuvring arm 20 is fixed to the support 22 so as to allow a rotation of the arm itself around a horizontal axis X. More precisely, the end 20a has fixed to it a bracket 68 with two holes 70,72, the axes of which are arranged parallel to the manoeuvring arm 20. The support 22, on the other hand, is provided with two lugs 74,76 in each of which a hole is formed. The bracket 68 is hingeably mounted on the support 22 by means of a pin engaging in the hole 70 of the bracket 68 and in the hole of the lug 74. When the manoeuvring arm 20 is arranged vertically (see FIG. 8), the bracket 68 is fixed to the support 22, engaging a pin in the hole 72 of the bracket 68 and in the hole of the lug 76.

Operation of the device is as follows:

First of all one end 28*a* of the cable 28 is fixed to the top of the slope, while the second end is passed over the pulleys 27 of the manoeuvring arm 20. The cable 28 is wound around the two guide rollers 34, 36, being slidably housed inside the grooves 37 and passing alternately from one roller to the other.

The cable 28 is then passed over the deviating roller 40 and then into each of the pair of rollers 64 and 66 of the distributor 38; finally, the second end is fixed to the winding drum 30.

At this point, by means of the motor 26, the manoeuvring arm 20 is made to rotate about its vertical axis Y so as to align it with respect to the cable 28.

Then the hydraulic motor 41 driving the friction group 32 and the motor driving the winding drum 30 are started up until the cable 28 is tensioned. At this point the vehicle 10 is able to start travelling up the slope, while the cable 28 is coiled around the winding drum 30. At the same time the screw 58 of the distributor 38 is made to rotate so that the cable 28 is coiled up uniformly around the winding drum 30, thus limiting substantially the variation in the winding diameter of the cable between the moment of departure and arrival.

When a particularly difficult situation arises, such as for example the negotiation of a hump or the yielding of the underlying snow layer, where the pulling force of the winching cable exceeds the force generated by the motor 41, the lamellar brakes 56 intervene in order to block the rollers 34 and 36, preventing them from rotating in the opposite direction and hence the winding drum 30 from releasing the cable 28. Consequently the vehicle is prevented from moving backwards or, even worse, from sliding down the slope and endangering the lives of its occupants.

If, however, the pulling force of the cable 28 reaches the limit value consisting of the frictional force generated between the cable itself and the guide rollers 34 and 36, the winching cable starts to slip slowly on the guide rollers which are blocked.

The slipping of the cable 28 over the guide rollers 34 and 36 allows the vehicle 10 to reverse and hence move away from the obstacle encountered.

The friction group 32 therefore functions as a means for limiting the stress to which the cable 28 and the device 18 are subject, thus preventing possible breakages caused by sudden and intense forces which may be generated following circumstances such as those described above.

On the other hand, if the vehicle 10 should need to be transported, passing underneath low bridges, or be parked in garages with low ceilings, it is sufficient, starting from the operating condition shown in Figure 8, to disengage the fixing pin from the hole of the lug 76 and from the hole 72 of the bracket 68 and tilt the manoeuvring arm 20 (FIG. 9) through 90° .

Moreover, the device can also be used for the downhill travel of the vehicle, during which, instead of coiling up the winching cable, it has the function of releasing it from the winding drum.

In the case where the motor itself of the vehicle is not able to ensure a uniform descent of the vehicle or should the layer of snow give way, the device prevents the vehicle from reversing suddenly, keeping the speed of descent more or less constant. If the tensioning force of the cable should reach such a value that the hydraulic motor of the device is unable to guarantee a uniform descent, the brakes or lamellae will enter into operation in order to block the guide rollers so that the tensioning force is opposed by the friction between cable and guide rollers. If, on the other hand, the force is very high, the cable slips around the rollers so that the vehicle moves back slowly until it reaches a stable position.

Finally it is possible to use the device in the condition where the guide rollers are blocked, allowing the vehicle to move sideways in total safety.

The device according to the invention may be subject to changes conceptually equivalent without departing from the scope of the present invention.

For example, instead of providing two guide rollers around which the winching cable is wound beforehand, it is possible to have only one roller; or also, instead of providing a plurality of circular grooves arranged alongside one another, it is possible to provide a helical groove for each guide roller. Referring now to FIGS. 10 to 18 a modified embodiment of the device according to the present invention is described. In said figures the same elements of the preceding figures are marked with the same numeral references and accordingly the description thereof will be omitted. The device 18 comprises also in this case, a winding drum 30, illustrated in more detail in FIGS. 12 and 13, which is operated by a suitable hydraulic motor (not shown in the Figures). The winding drum 30 comprises a roller 132, rotating about an axis X', inside which the cable 28 is wound and which is supported at both its axial ends **130*a*, 130*b* by means of bearings 134. At the axial end 130*a* the winding drum 30 is provided moreover with a transmission group, denoted overall by 136 and illustrated in detail below with reference to FIGS. 15, 16 and 17, to which a hydraulic drive motor (not shown in the Figures) is connected. The winding drum 30 is provided with a detection and control member 139 (see FIGS. 12 and 14) designed to detect the winding radius of the cable wound around the roller 132** and adjust the speed of rotation of the hydraulic motor so that the linear speed with which the cable is coiled up is constant.

Finally, the device 18 is provided with a distributor 138, described in detail below with reference to FIG. 18, which has the function of uniformly distributing the turns of the cable 28 on the surface of the roller 132.

Figure 12:
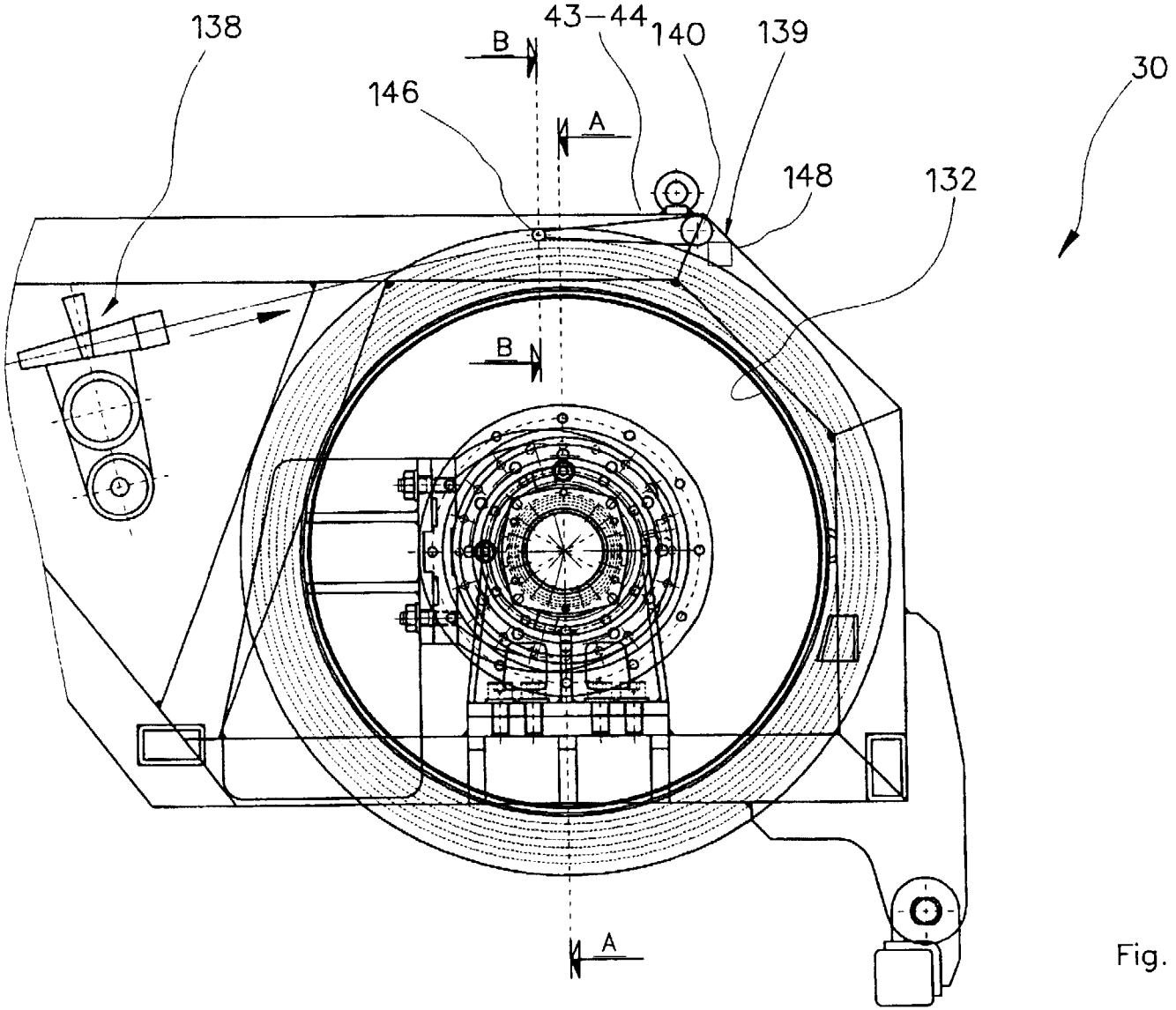
FIG. 12 illustrates an enlarged detail of the winding drum according to FIG. 11.
Figure 13:
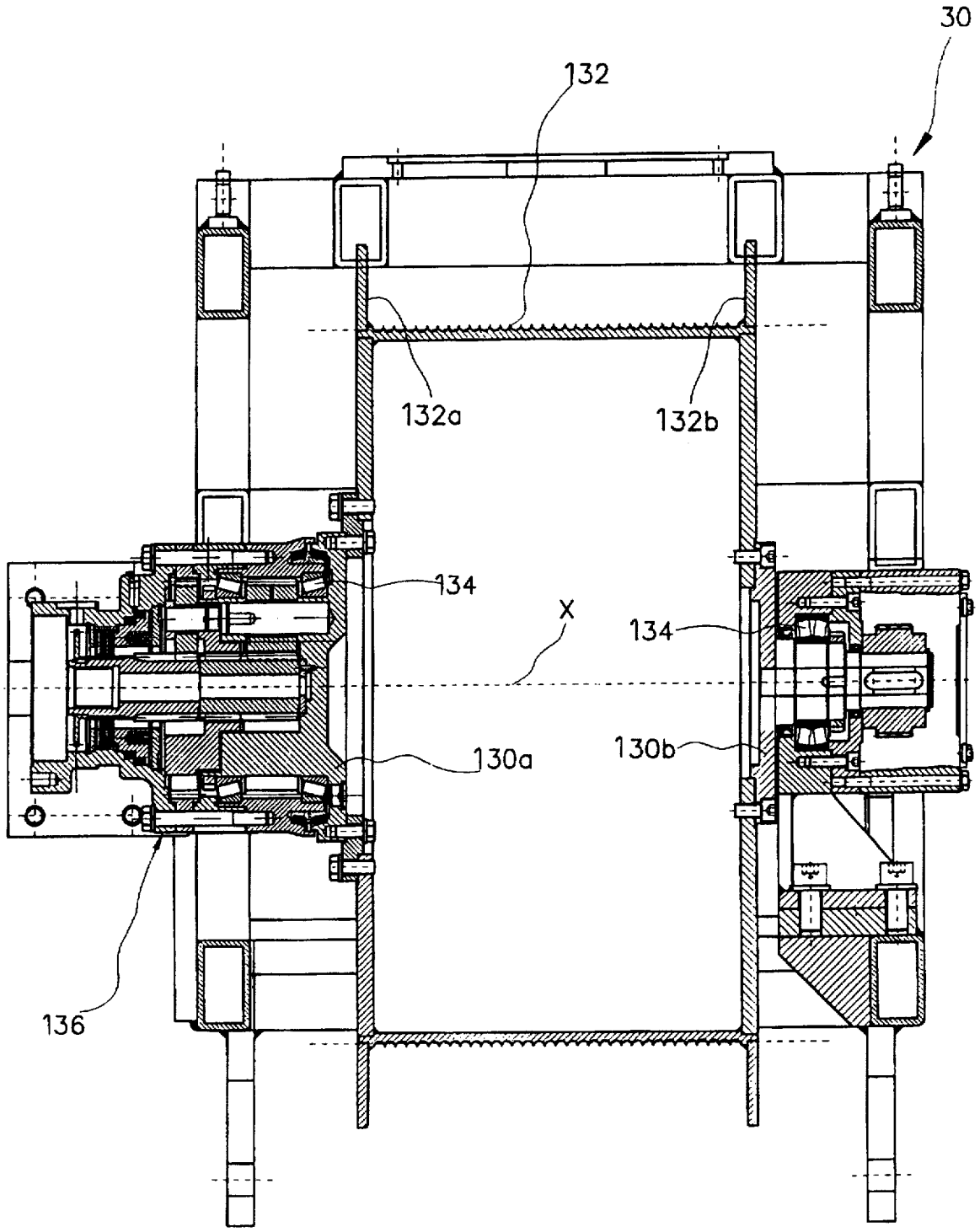
FIG. 13 is a cross-section through the winding drum along the plane indicated by A-A in FIG. 12.
Figure 14:
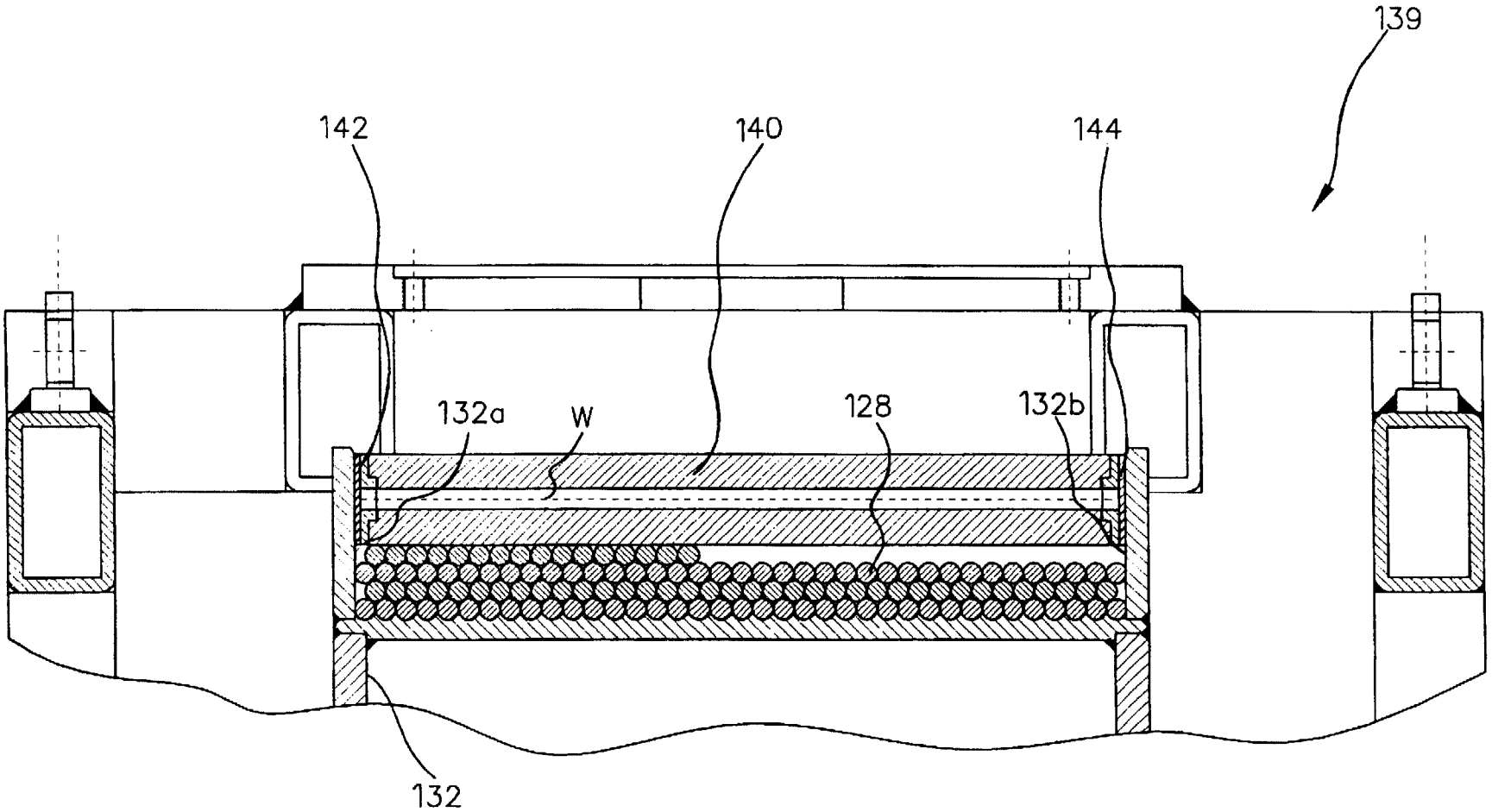
FIG. 14 is a cross-section along the plane indicated by B-B in FIG. 12.

Considering now FIGS. 12 and 14, it can be noted that the detection and control member 139 comprises a sensing cylinder 140 arranged inside the roller 132 between its walls (**132*a*, 132*b*) and rotatably supported at both its ends at the two ends of two arms 142, 144 so as to be rotatable about an axis W parallel to the axis of rotation X' of the roller 132. The length of the cylinder 140 is such that the two arms 142, 144 are able to slide on the internal surfaces of the two side walls 132*a*, 132*b* of the roller 132. The arms 142 and 144, at the opposite ends to those supporting the cylinder 140, are pivotably mounted by means of a pin 146 positioned above the roller 132; consequently the cylinder 140, owing to the force of gravity, remains in contact with the cable 28 wound inside the roller 132 and, as the layers of wound cable increase, the cylinder 140 is raised while still remaining in contact with the upper layers of the cable. The cylinder 140 has moreover coupled to it an electromechanical device, indicated schematically by the reference number 148, which is designed to detect the position of the cylinder 140 and adjust the speed of rotation of the hydraulic drive motor of the winding drum 30** so that the linear coiling speed of the cable is kept constant. Consequently, as the winding radius of the cable and hence the number of turns of the wound cable increase, the number of revolutions of the drive motor is correspondingly reduced. It can be noted that the cylinder is freely rotatable about its own axis, thus limiting the friction which is generated between its external surface and the upper layers of the wound cable.

Figure 15:
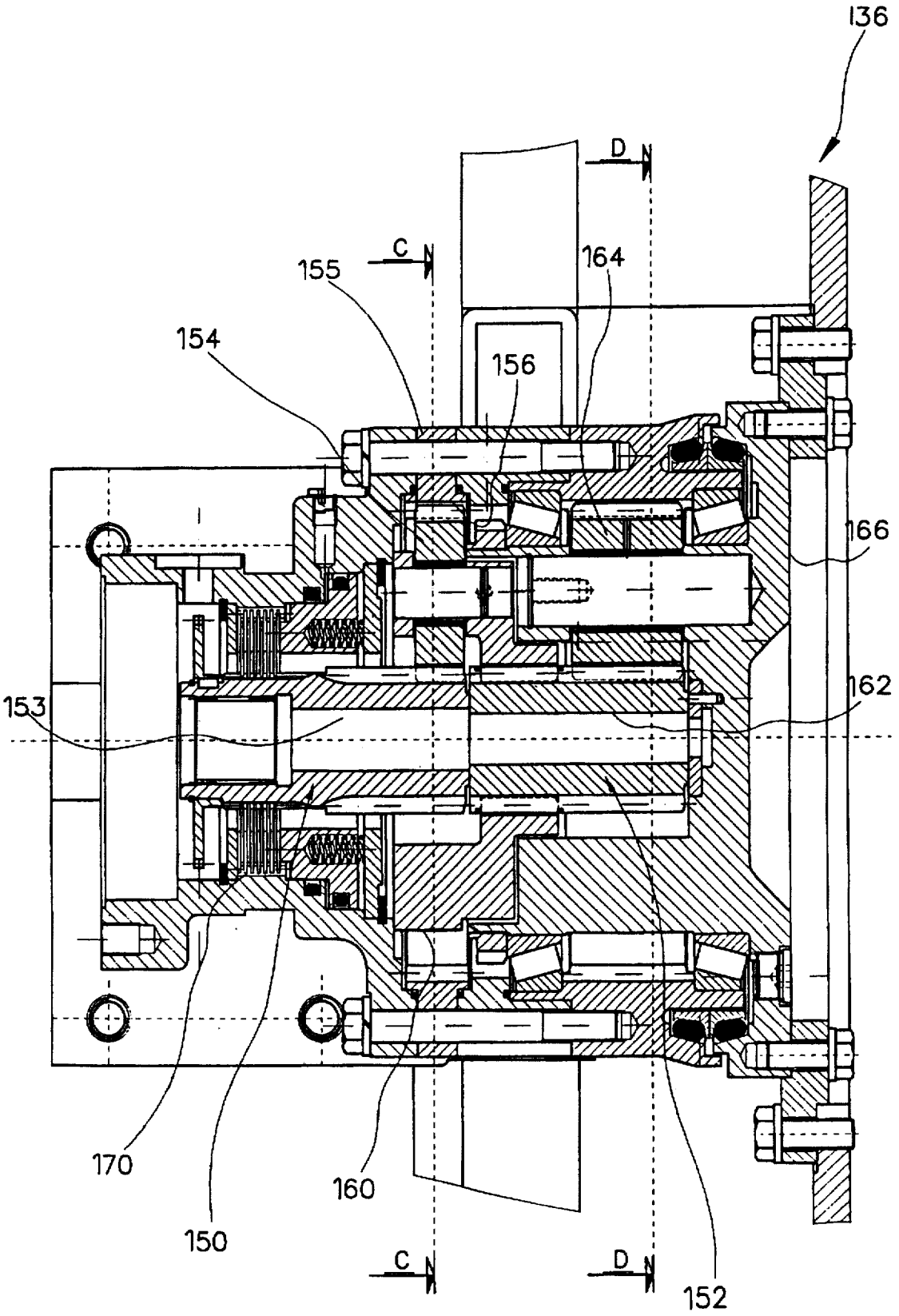
FIG. 15 shows, on a larger scale, the detail of the transmission means shown in FIG. 13.
Figure 17:
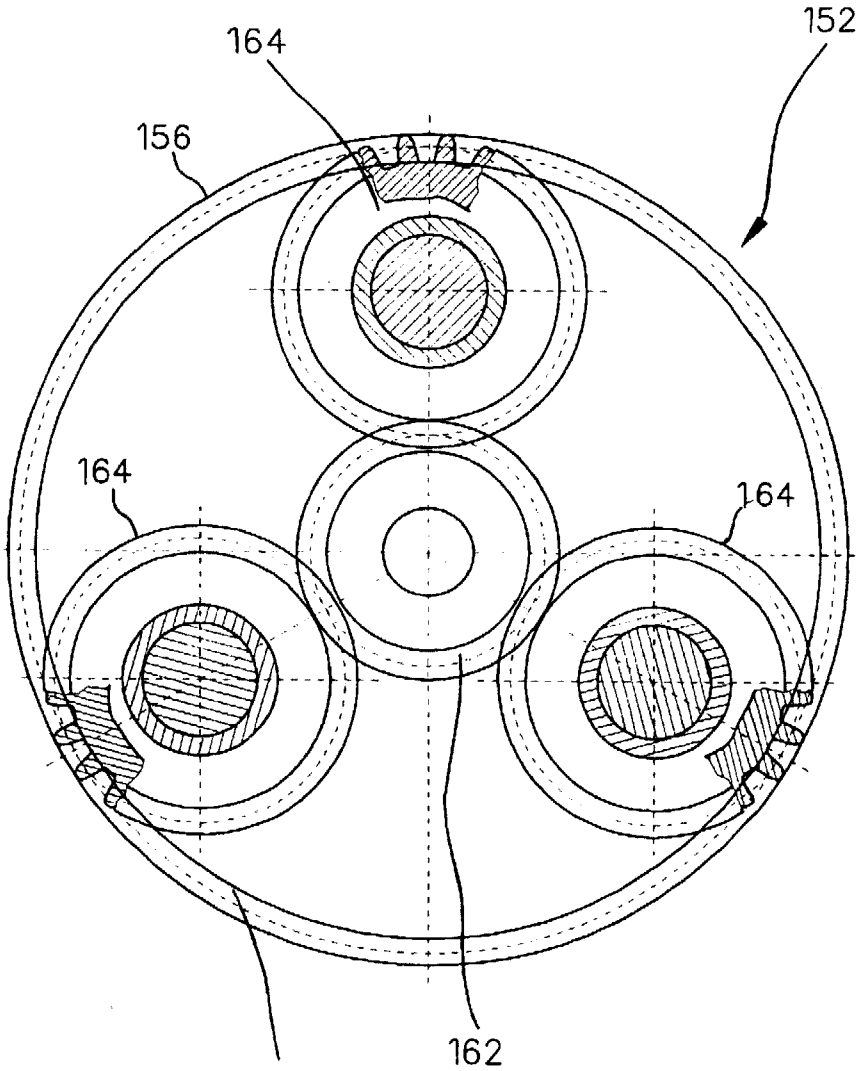
FIGS. 16 and 17 are cross-sections along the lines C-C and D-D of FIG. 6, respectively.
Figure 16:
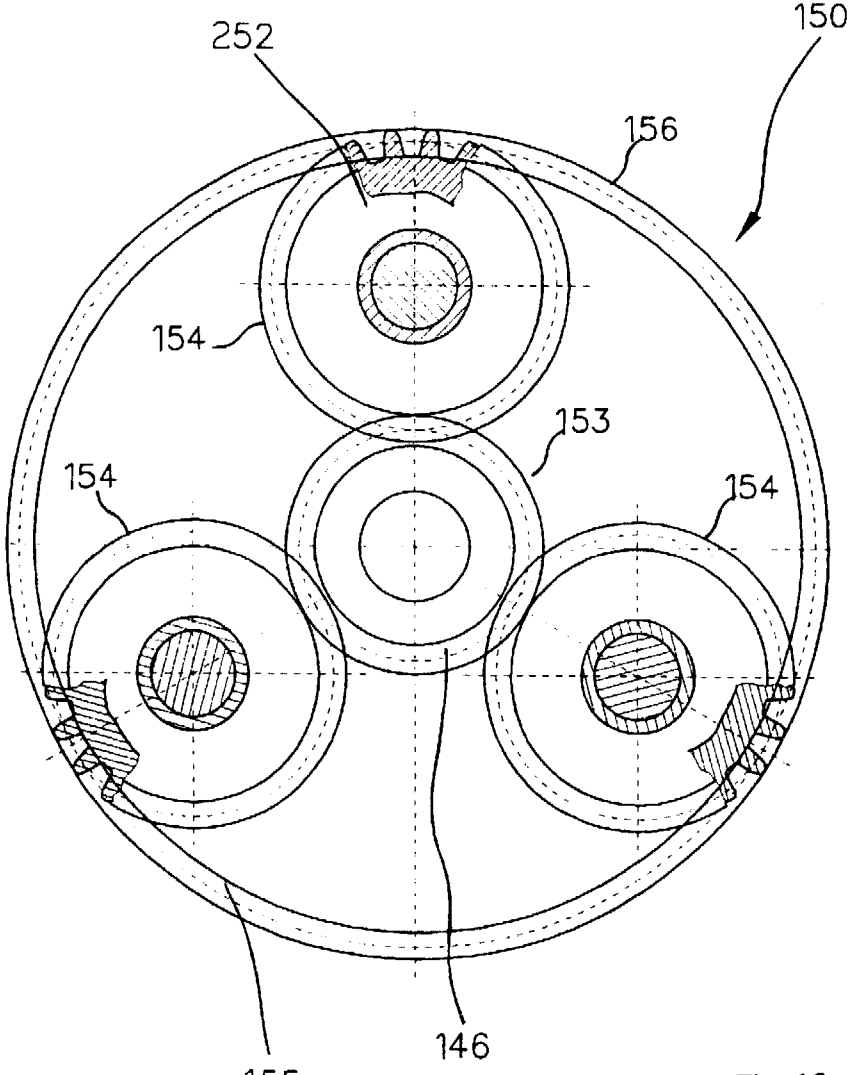

Examining now FIGS. 15, 16 and 17, it can be noted that the transmission group 136 comprises a first and a second epicyclic reducer denoted by 150 and 152, respectively. The first reducer 150 comprises a central or sun pinion 153 connected to the shaft of the hydraulic drive motor and three peripheral or planetary gears 154 arranged angularly at the same distance from one another along the external toothing of the central pinion 153. The three planetary gears 154 mesh with the internal toothing of a crown ring 156 formed on the inside of the casing of the transmission group 136. The three planetary gears 154 are rotatably supported on a crown ring 160 provided with an internal toothing meshing with a central or sun pinion 162 of the second reducer 152. In the similar manner to the first reducer, the second reducer 152 is further provided with three peripheral or planetary gears 164 which are arranged angularly at the same distance along the external toothing of the central pinion 162 and which mesh with the internal toothing of the crown ring 156. Finally, the three planetary gears 164 are rotatably supported on the hub 166 of the roller 132.

Furthermore a hydraulic lamellar safety brake of the commercial type is provided, said brake being denoted by 170 and having the function of blocking reverse rotation of the roller 132 so as to prevent release of the cable 28 wound around it.

Figure 18:
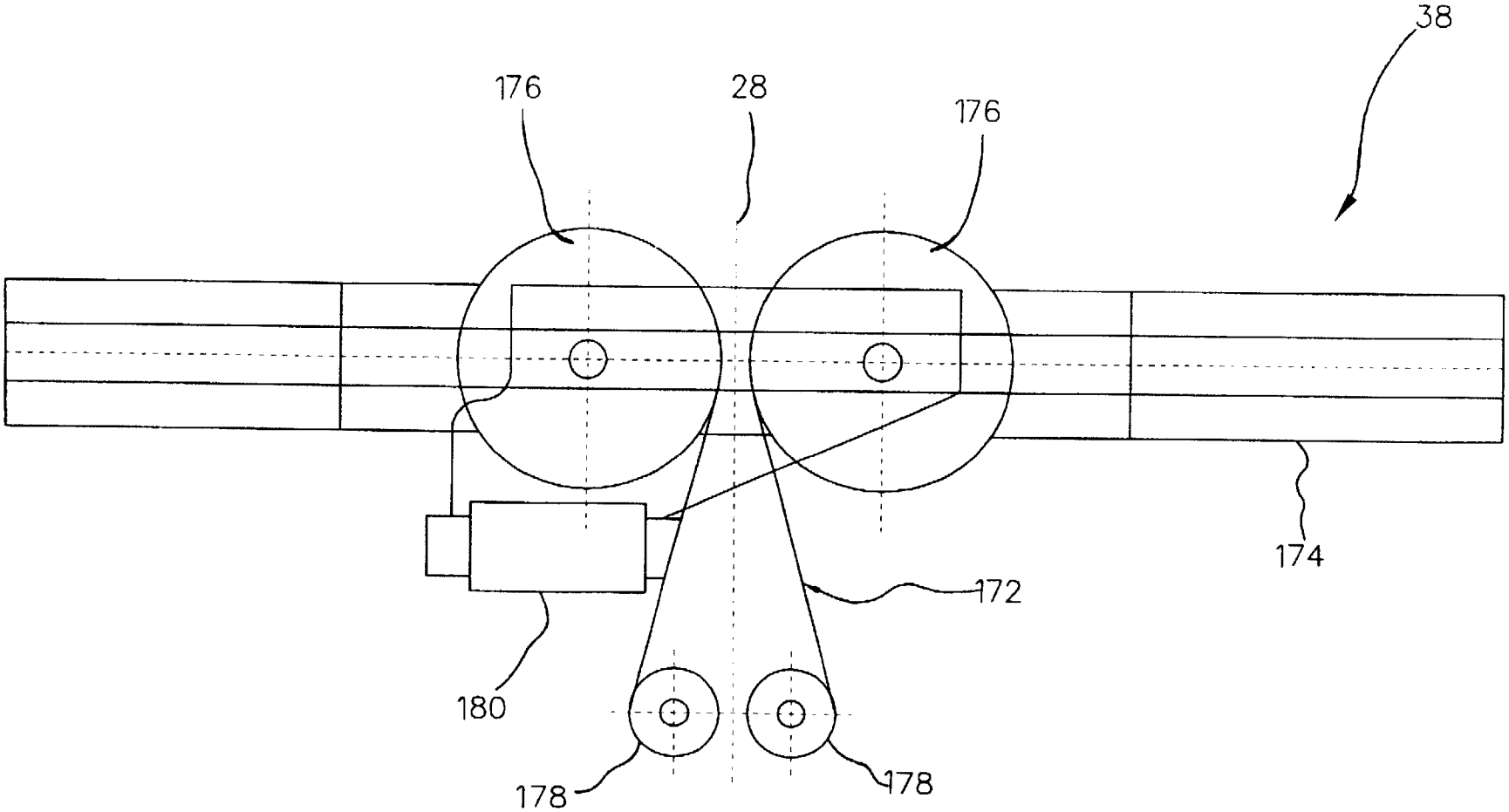
FIG. 18 is a longitudinal view of the cable distributor shown in FIGS. 11 and 12.

Finally, FIG. 18 illustrates the cable distributor 138 which has the function of ensuring that the cable 28 is uniformly wound over the entire width of the roller 132.

The distributor 138 comprises a guide element 172 which moves along a rectilinear guide 174 arranged parallel to the axis X' of the roller 132 (see FIG. 12). The guide element 172 includes a first and a second pair of rollers denoted by 176 and 178, respectively, the axes of rotation of which are perpendicular to the axis of rotation X' of the roller 132 and to the cable 28; in each pair 176, 178, the rollers are arranged opposite one other and the cable 28 travels between them.

The guide element 172 moves along the guide 174 by means of a control and operating device, schematically indicated by 180 and known per se, which, as soon as its detects overlapping of the cable, moves the guide element 172 over a distance equivalent to the diameter of the cable, thus ensuring uniform winding of the cable. Obviously, when the cable has been wound over the entire surface of the roller 132, the device 180 will cause reversal of the movement of the guide element 172, thus allowing the cable to be wound in such a way as to form a further layer.

Operation of the device is as follows;

First of all a first end 28*a* of the cable 28 is fixed to the top of the slope, while the second end is passed over the pulleys 27 of the manoeuvring arm 20.

The cable 28 is then passed through each of the two pairs of rollers 176 and 178 of the distributor 138 and finally the second end is fixed to the roller 132 of the winding drum 30.

At this point the manoeuvring arm 20 is rotated about its axis of rotation Y so as to align it with respect to the cable 28.

Subsequently, the hydraulic drive motor of the roller 132 is started up so as to tension the cable 28.

At this point the vehicle is able to start travelling up the slope, as the cable 28 is coiled up around the roller 132.

At the same time the distributor 138 is activated so that the cable 28 is uniformly wound up around the roller 132, therefore substantially limiting the variation in the winding diameter of the cable between the moment of departure and arrival.

Each time the cable has been uniformely wound over the entire surface of the underlying cable layer and must therefore be wound so as to form a new layer, the detection and control member 139 reduces the speed of rotation of the drive motor of the roller 132 so as to keep the linear coiling speed of the cable constant.

Furthermore, the device may be also used for the downhill travel of the vehicle during which, instead of the coiling up the winching cable, it has the function of releasing it from the winding drum.

Finally it is possible to use the device in the condition where the winding drum is blocked, thus allowing the vehicle to be displaced laterally in total safety.

Finally, it is obvious that any conceptually equivalent modification or variation falls within the scope of the present invention.

I claim:

1. Safety device for the manoeuvring and auxiliary winching of self-propelled vehicles used on steep slopes, of the type comprising a manoeuvring arm (20) associated with the vehicle itself (10) freely rotatably about an axis (Y), perpendicular to the plane in which said vehicle lies, a winding drum (30) operated by drive means (41) and designed to wind at one end a winching cable (28) running along said arm (20), while the other end (28*a*) of cable (28) is fixed to the top of the slope to be travelled up, said device (18) being moreover provided with braking means (56) designed to prevent the release of the cable (28) wound around the winding drum (30), and at least one guide and traction roller (34, 36) around which the cable (28) is wound with friction for a plurality of turns before it is coiled up by means of winding around said winding drum (30), said device being further characterized in that it comprises a detection and control member (139) designed to detect the winding radius of the cable wound around a winding roller (132) and adjust the speed of rotation of the drive means of the winding roller (132) so that the linear coiling speed of the cable (28) is constant.

2. Device according to claim 1, wherein braking means (56) are applied to said at least one guide roller (34, 36) and are designed to prevent release of the cable (28) wound around the winding drum (30).

3. Device according to claim 2, wherein at least one said guide roller (34, 36) is operated by said drive means (41).

4. Device according to claim 3, wherein said guide rollers (34, 36) are two and the winching cable (28) is wound alternately around the first and the second roller.

5. Device according to claim 4, wherein each of said two guide rollers (34, 36) has formed in it a plurality of grooves (37) inside which the winching cable (28) is wound.

6. Device according to claim 5, comprising seven grooves (37) for each said roller (34, 36).

7. Device according to claim 6, comprising a device (38) for distributing the cable (28), which performs a transverse movement and is located between said winding drum (30) and a friction member (32) and is designed to allow uniform winding of the cable (28) around the winding drum (30).

8. Device according to claim 6, wherein said manoeuvring arm (20) is pivotably mounted about an axis (X) which is substantially horizontal and parallel to the longitudinal axis of the vehicle (10) so as to be able to assume a first operating position in which it is arranged in a vertical plane and a second rest position where it is arranged inclined with respect to said first operating position.

9. Device according to claim 6, comprising drive means (26) coupled with transmission means (24, 25) for rotating the manoeuvring arm (20) about its vertical axis.

10. Device according to claim 1, comprising drive means (26) coupled with transmission means (24, 25) for rotating the manoeuvring arm (20) about its vertical axis.

11. Device according to claim 1, wherein said detection and control member (139) comprises a sensing cylinder (140) located above the layers of the cable (28) wound around a winding roller (132).

12. Device according to claim 11, wherein said sensing cylinder (140) is supported rotatably at an end of each of arms (142, 144) pivotably mounted in a position above a roller (132).

13. Device according to claim 12, wherein the length of the sensing cylinder (140) is such that a arms (142, 144) slide inside two vertical walls (132*a*, 132*b*) defining a roller (132).

14. Device according to claim 1 including transmission means (136) comprising two reducers (150, 152).

15. Device according to claim 14, wherein said reducers (150, 152) are an epicyclic train.

16. Device according to claim 15, wherein said first reducer (150) comprises a central pinion (153) connected to the shaft of said drive means (41) and three planetary gears (154) arranged angularly at the same distance from one another along external toothing of the central pinion (153), the three planetary gears (154) meshing with the internal toothing of a crown ring (156) formed on the inside of a casing (155) containing transmission means (136) and the three planetary gears (154) being supported rotatably on a crown ring (160) provided with an internal toothing meshing with a central pinion (162) of the second reducer (152).

17. Device according to claim 16, wherein said second reducer (152) is further provided with three planetary gears (164) arranged angularly at the same distance from one another along external toothing of the central pinion (162), the three planetary gears (164) meshing with internal toothing of the crown ring (156) and being supported rotatably on a hub of roller (132).

18. Device according to claim 1, comprising a device (38) for distributing the cable (28), which performs a transverse movement and is located between said winding drum (30) and a friction member (32) and is designed to allow uniform winding of the cable (28) around the winding drum (30).

19. Device according to claim 1 wherein said manoeuvring arm (20) is pivotably mounted about an axis (X) which is substantially horizontal and parallel to the longitudinal axis of the vehicle (10) so as to be able to assume a first operating position in which it is arranged in a vertical plane and a second rest position where it is arranged inclined with respect to said first operating position.

20. Device according to claim 19, wherein in said second operating position the manoeuvring arm (20) is tilted horizontally.

* * * * *